United States Patent [19]

Bithell

[11] Patent Number: 4,792,261

[45] Date of Patent: Dec. 20, 1988

[54] MINE ROOF SUPPORTS

[75] Inventor: Tom C. Bithell, Chorley, England

[73] Assignee: Gullick Dobson Limited, Wigan, England

[21] Appl. No.: 30,528

[22] Filed: Mar. 27, 1987

[30] Foreign Application Priority Data

Apr. 1, 1986 [GB] United Kingdom ..... 8607932

[51] Int. Cl.[4] ..... E21D 15/44; E21D 17/02

[52] U.S. Cl. ..... 405/293; 405/295; 405/296

[58] Field of Search ..... 405/291, 293, 295, 296, 405/299; 299/33

[56] References Cited

U.S. PATENT DOCUMENTS

| | | | |
|---|---|---|---|
| 3,928,981 | 12/1975 | Parker et al. | 405/293 |
| 4,027,489 | 6/1977 | Walker et al. | 405/296 |
| 4,236,850 | 12/1980 | Koppers et al. | 405/291 |
| 4,380,410 | 4/1983 | Bull et al. | 405/299 |
| 4,422,807 | 12/1983 | Dettmers et al. | 405/296 |

FOREIGN PATENT DOCUMENTS

| | | |
|---|---|---|
| 1431609 | 4/1976 | United Kingdom . |
| 2007749A | 5/1979 | United Kingdom . |
| 2042036A | 9/1980 | United Kingdom . |
| 2050482A | 1/1981 | United Kingdom . |
| 2067640A | 7/1981 | United Kingdom . |

*Primary Examiner*—David H. Corbin

*Attorney, Agent, or Firm*—Armstrong, Nikaido, Marmelstein & Kubovcik

[57] ABSTRACT

A self-advancing mine roof support comprising a floor engaging base 11, a roof engaging canopy 12, hydraulic jacks 19*a*, 19*b* to urge the base and canopy apart, and a linkage system located towards the rear of the support. The linkage system comprises an inclined shield member 22 pivotally connected to the canopy 12, and at least two links 23, 24 interconnecting the shield and the base. The jacks 19*a*, 19*b*, are located substantially halfway along the length of the base and extend substantially vertically from the base. There is a hydraulic jack 18 operable between the roof engaging canopy 12 and the linkage system to effectively counterbalance the projection on the canopy 12 which extends forwardly of the jacks 19*a*, 19*b*.

12 Claims, 4 Drawing Sheets

MINE ROOF SUPPORTS

The invention relates to mine roof supports.

Modern mine roof supports generally comprise a floor engaging base and a roof engaging canopy interconnected by legs in the form of hydraulically operated jacks. The supports are usually connected by means of a hydraulic ram to a mine face conveyor. After a web of mineral has been cut away by moving a cutting machine along the mine face, the conveyor is advanced by extending the hydraulic ram which connects the conveyor to the supports. The roof engaging canopies of the supports are then selectively lowered, the supports are selectively advanced to a position adjacent to the conveyor, and the supports are then selectively re-set to the mine roof to support the mine roof. The evolution of such mine roof supports has been governed primarily by mechanical engineering, operational and safety factors.

Even the apparent and operational mining problems have been solved within the above mentioned governing factors.

Work carried out by Universities, and notably the Mining Department of Cardiff University, has indicated the effect on the strata caused by roof supports of differing configurations, and the importance of stress distribution on the strata resulting from the use of the supports.

The more recent introduction of computer aided designs for mine roof supports and the ability to relate the effect of such designs on the strata has resulted in new generations of roof supports based upon actual rather than adjudged conditions, albeit by experienced personnel.

Incorrect loading or stress distribution on the strata above and below the support can cause fractures in the indigenous strata and the mining conditions subsequently deteriorate resulting in lower output and often the need to apply a remedial treatment for example by using timber supports, to allow mining to continue.

It is an object of the invention to alleviate or eliminate the problems caused by an inappropriate design of mine roof support being applied to a particular type of mining condition.

As mentioned above, self-advancing mine roof supports operate in a specific sequence related to the passage of the mining machine and the subsequent movement of the conveyor.

In what is known as the conventional method, the conveyor is advanced after passage of the cutting machine but before the supports are moved, as described above. However in an alternative method of operating, known as the immediate forward support or I.F.S. method, the supports are initially spaced from the conveyor and are moved up to the conveyor immediately after the passage of the cutting machine and before the conveyor is itself moved. A typical I.F.S. support will have a forwardly extending cantilever roof engaging canopy, which, when the support is advanced up to the conveyor, will extend beyond the leading edge of the conveyor by approximately the width of cut taken by the mining machine. With a conventional support, the forward tip of the roof engaging canopy will be aligned with the leading edge of the conveyor when the support is adjacent the conveyor.

The invention is applicable to both I.F.S. and conventional working of a mine face, and the relationship between the base of the support, and hence the conveyor, and the tip of the roof engaging canopy, is controlled by a substantially linear-generative linkage connected to the floor engaging base of the support.

According to one aspect of the present invention, a self-advancing mine roof support comprises a floor engaging base, a roof engaging canopy, jack means to urge the base and canopy apart, and a linkage system located towards the rear of the support, the linkage system comprising an inclined shield member pivotally connected to the roof engaging canopy and at least two links interconnecting the shield and base, the jack means being located substantially halfway along the length of the base and extending substantially vertically from the base, there being a hydraulic jack operable between the roof engaging canopy and the linkage system to effectively counterbalance the projection of the roof engaging canopy which extends forwardly of the hydraulic jack means.

The base may comprise two parallel floor engaging members which may be rigidly connected together by a bridging element located between the hydraulic jack means and the linkage to avoid obstructing miners when they traverse the mine face between the hydraulic jack means and the mine conveyor.

The parallel floor engaging members may be of low profile box section forwardly of the hydraulic jack means and of deeper profile channel section to the rear of the hydraulic jack means, upstanding walls of the channel sections providing pivot bearings for the said links.

Preferably a hydraulic ram is located between the parallel floor engaging members and below the bridging element for connecting the support to the mine conveyor for use in the advancing of the mine conveyor and/or the support.

The leading end of the roof engaging canopy may have a pivotal cantilever extension which may be inclined upwardly to become load bearing and thus accommodate any undulations or steps experienced or caused by the cutting part of the mining machine.

According to another aspect of the invention, a self-advancing mine roof support comprises a base in the form of two spaced-apart floor engaging pontoons, rigidly connected by a bridging member, a roof engaging canopy, and hydraulic jack means supporting the roof engaging canopy from a location substantially at the mid-point along the length of the pontoons, the bridging member being located to the rear of but adjacent to the hydraulic jack means.

The position of the bridging member with respect to the pontoons is preferably such that in plan view the base has the appearance of an H.

The hydraulic jack means may be located in the rear half of the length of the roof engaging canopy.

Preferably the rear edges of the pontoons and roof engaging structure are alignable such that they will be substantially the same distance from the mine face in use.

Preferably there is a compensating jack attached between the roof engaging canopy and a linkage connecting the canopy to the base.

The linkage may comprise an upper shield member pivotally connected to the roof engaging canopy and at least one pair of links each pivotally connected to the base and to the shield member.

Preferably the longitudinal axis of the compensating jack is not parallel to a line joining the pivot points of the shield member i.e. there is a first acuate angle between the longitudinal axis of the compensating jack and the line joining the pivot points of the shield member.

Preferably a line joining the pivot points of one link of the said pair forms a second acute angle with a line joining the pivot points of the other link of the pair.

Preferably the said first acute angle is substantially equal to the said second acute angle.

Preferably as the roof engaging canopy is raised by the hydraulic jack means there is a consequential increase in the said acute angles.

Preferably as the canopy is raised the said acute angles open in the manner of a fan about a horizontal plane extending betwen the roof engaging canopy and the base. In other words the said angles lie on opposite sides of the said horizontal plane and as the angles increase the angle between the angles also increases.

Preferably the shield member comprises a wrap-around shield member.

Preferably the pivot point of the compensating jack on the roof engaging canopy lies behind the bridging member when the support is fully lowered.

Preferably the compensating jack lies between the pontoons of the base and above an advancing ram when the support is fully lowered.

By way of example, specific embodiments of the invention will now be described, with reference to the accompanying drawings; in which.

Figure 1:
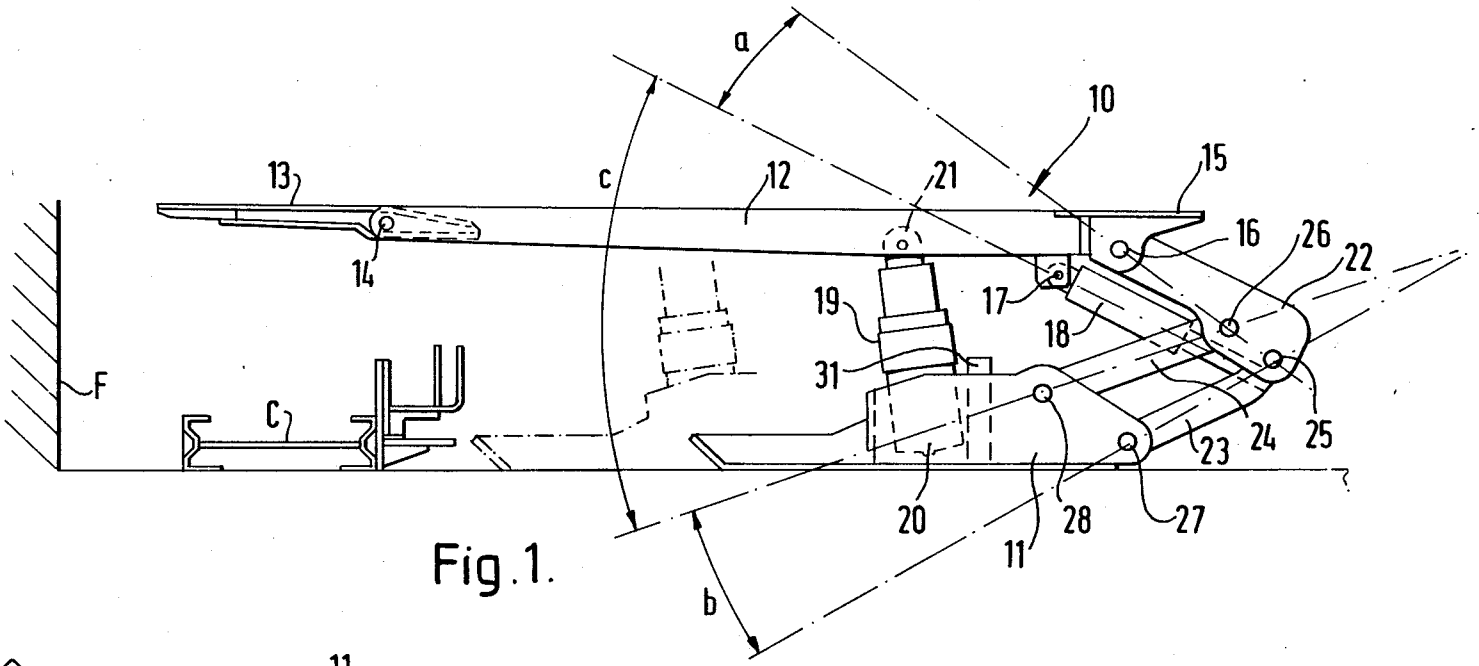
FIG. 1 is a side view of a first embodiment of mine roof support according to the invention.

FIG. 1 shows an embodiment of mine roof support 10 which, in use, may be positioned in the vicinity of a coal carrying conveyor C and a coal face F. The support 10 has a floor engaging base 11, and a roof engaging canopy 12. The canopy 12 has a cantilever extension 13 pivotally connected to the canopy at 14 and movable by a hydraulic jack (not shown) in a direction tending to urge the extension upwardly against a mine roof to provide additional support.

The canopy 12 also has a rear overhang 15 which prevents or restricts the ingress of material to pivots 16. A further pivot 17 is provided for a compensation ram 18. The canopy 12 is supported from the base 11 by means of two double telescopic jacks **19*a* and 19*b* which have spherical seatings in the base 11 at 20 and in the canopy 12 at 21. At the rear of the support 10 and pivotally attached to the canopy 12 by means of the pivots 16 is a wrap-around shield 22. This shield is, in turn, connected to the base by links 23 and 24. The links are pivotally connected to the shield 22 at 25 and 26, and to the base 11 at 27 and 28**.

The base 11 comprises two pontoon floor engaging members 29 and 30 rigidly interconnected by a bridging member 31 to form an H shape. A hydraulic jack 32 connects the support 10 to conveyor C to provide relative movement therebetween. Forming a travel track T for the miners, at the forward end of the base 11, are two box section portions of the pontoons 33 and 34.

The compensating ram 18 extends between the pivot 17 and a central bracket (not visible in the drawings), which projects from the centre of the rear portion of the shield 22.

It will be apparent that because of the substantial projection of the canopy 12 beyond the seatings 21, there will be a tendency for the leading edge of the canopy 12 to tip downwardly. This tendency is counteracted by the compensating ram 18.

It will be seen from FIG. 1 that the longitudinal axis of the compensating jack 18 is not parallel to a line joining the pivot points of the shield member. Thus there is an acute angle a between the longitudinal axis of the compensating jack and the line joining the pivot points of the shield member.

Furthermore, the lines joining the respective pivot points of the links 23 and 24 are not parallel but on the contrary form a second acute angle b. The acute angles a and b are substantially equal and they increase as the roof engaging canopy is raised.

The acute angles a and b lie on opposite sides of a horizontal plane extending between the roof engaging canopy and the base. As the angles a and b increase, they move further apart. In other words the angle c also increases. Thus the angles a, b and c open in the manner of a fan as the roof engaging canopy is raised.

Figure 4:
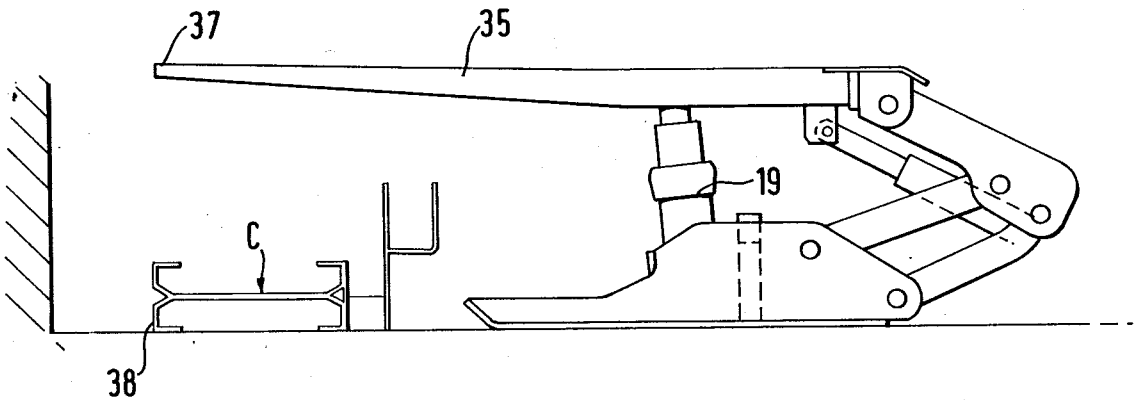
FIG. 4 is a side view of an alternative embodiment according to the invention, for use in conventional working.

FIG. 4 illustrates an alternative embodiment of the invention which is identical in many respects to the embodiment shown in FIG. 1, but which utilizes a rigid canopy 35 without the forward extension 13.

Figure 5:
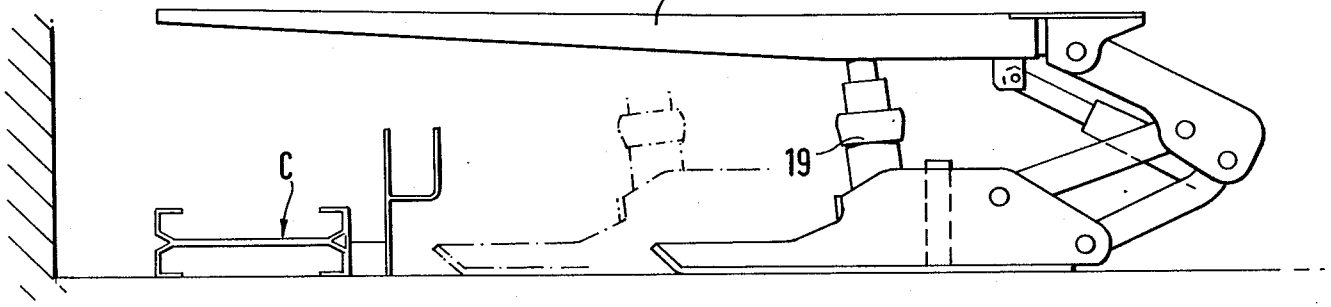
FIG. 5 is a view similar to FIG. 4 but showing a support suitable for use in the I.F.S. system of working.

FIG. 5 illustrates yet another embodiment, again employing a rigid canopy 36 without a forward extension 13. The embodiments shown in FIGS. 4 and 5 are designed for use in normal and I.F.S. working respectively.

It will be seen from FIG. 4 that when the support is positioned adjacent to the conveyor C, the leading edge 37 of the canopy 35 is vertically aligned above the leading edge 38 of the conveyor C. Once a coal cutting machine has been used to cut away a web of coal, the conveyor C will be advanced by extending a ram (not shown) interconnecting the supports and the conveyor. The supports will then be selectively lowered from the roof and drawn forward to lie adjacent to the conveyor once more by retracting the ram.

With the support shown in FIG. 5, there is a different sequence of operations. In will be seen that the base of the support shown in FIG. 5 is spaced from the conveyor C. Once a web of coal has been cut away, the supports are selectively advanced to the position shown in chain lines, before the conveyor is advanced.

Figure 6:
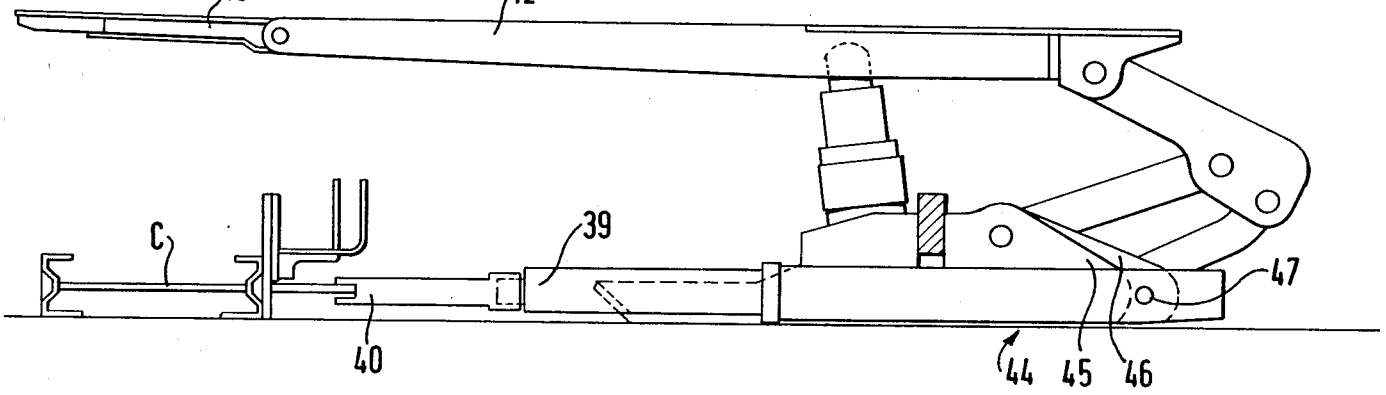
FIG. 6 is a side view of yet another embodiment of support according to the invention.
Figure 3:
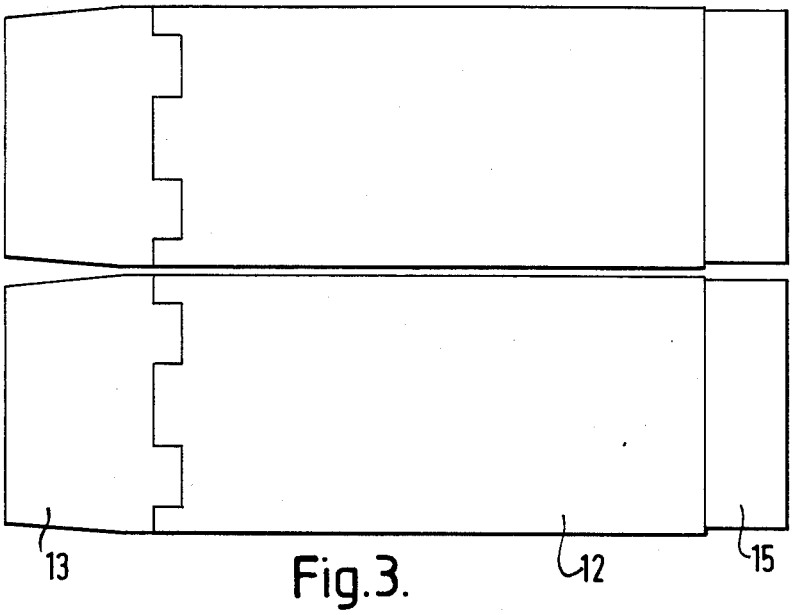
FIG. 3 is a plan view of the supports shown in FIG. 2.

FIG. 6 shows yet another embodiment of support according to the invention which is very similar to that shown in FIG. 1, having a canopy 12 with a forward extension 13. Although it is not visible in FIG. 6 there is also a compensating ram similar to the ram 18.

Figure 7:
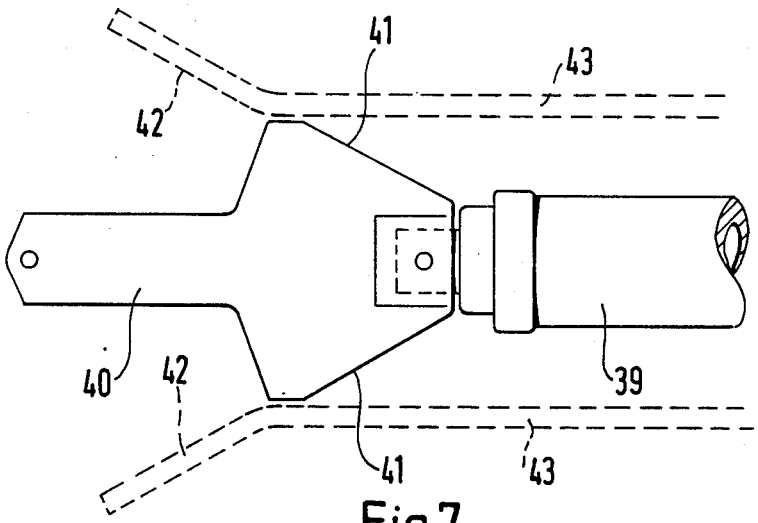
FIG. 7 is a plan view of part of the support shown in FIG. 6.

FIG. 6 shows in particular detail the hydraulic ram 39 which is used to connect the support to the conveyor C. As best shown in FIG. 7, the ram 39 is connected to the conveyor by means of a link 40 which has two tapered surfaces 41. These tapered surfaces co-operate with flared portions 42 of base pontoons 43 to centralise the ram 39 when it is retracted.

A further important feature of the embodiment shown in FIGS. 6 and 7 relates to the rear portions 44 of the pontoons. In this region, each pontoon comprises a channel section with the mouth of the channel facing upwardly. The two walls 45 and 46 of the channel are of different lengths, as can clearly be seen from FIG. 6. The inner wall of each channel section projects rearwardly for a greater distance than the associated outer wall 45. The rear end of the ram 39 is pivotally connected to the walls 46 by a pivot pin 47.

Figure 8:
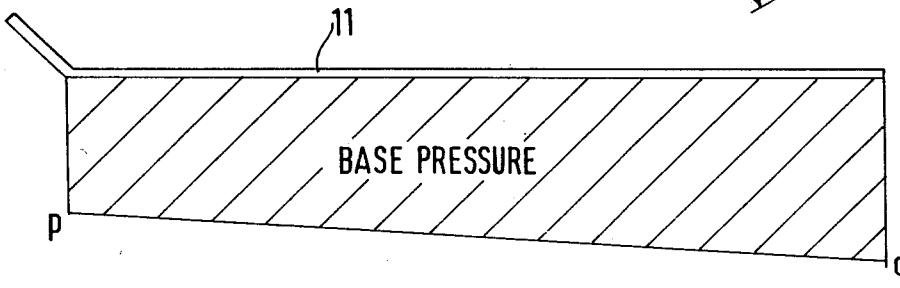
FIG. 8 is a diagrammatic view showing how the pressure on the strata may vary underneath the support shown in FIGS. 6 and 7.
Figure 2:
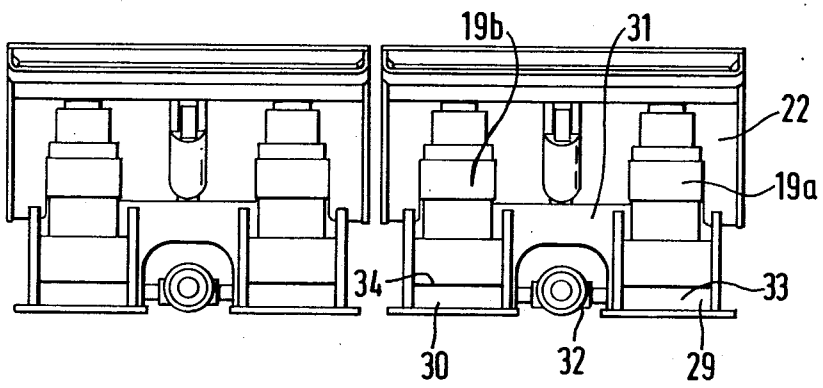
FIG. 2 is a front view of the support shown in FIG. 1, positioned adjacent to an identical support.

All the above described embodiments, whilst only requiring two supporting legs 19*a* and 19*b*, nevertheless provide an effective support in which load is evenly spread over the mine roof and the mine floor. This is a very important consideration in avoiding problems of disturbing the strata as described above. FIG. 8 illustrates how the pressure on the mine floor is fairly evenly distributed over the base 11 from a point p to a point q. At the point p the pressure may be while at the point q the pressure is 327 p.s.i.

With known supports, there may be a much more uneven distribution of base pressure. For example the pressure may vary from 202 p.s.i. at point p to 378 p.s.i. at point q.

The invention is not restricted to the details of the foregoing embodiments.

I claim:

1. A mine roof support, comprising:

a mine floor engaging base having a front and a rear, said base including elongate spaced-apart floor engaging members extending parallel to one another from said front to said rear;

a mine roof engaging canopy;

first hydraulic jack means connected to said base and said canopy for urging said canopy upwardly into load bearing contact with said mine roof;

connecting means extending between said two spaced-apart floor engaging members for connecting said floor engaging members together, said connecting means being disposed behind said first hydraulic jack means towards said rear;

linkage means at said rear of said base and disposed behind said connecting means for pivotally connecting said base and said canopy;

second hydraulic jack means pivotally connected between said canopy and said linkage means and disposed behind said connecting means towards said rear for providing even distribution of load along said base;

pivotal connection means connected to said canopy behind said connecting means towards said rear for pivotally connecting said second hydraulic jack means to said canopy.

2. A mine roof support as claimed in claim 1, in which said parallel floor engaging members are of low profile box section forwardly of said first hydraulic jack means and of deeper profile channel section rearwardly of said first hydraulic jack means, said channel section having upstanding walls, said upstanding walls providing pivot bearings for said linkage means.

3. A mine roof support as claimed in claim 1, in which an advancing hydraulic ram is located between said spaced-apart floor engaging members and below said connecting means for connecting said mine roof support to a mine conveyor for effecting relative movement between said mine conveyor and said support.

4. A mine roof support as claimed in claim 1, in which a leading edge of said roof engaging canopy is provided with a pivotal cantilever extension which is inclinable upwardly to become load bearing and accommodate any undulations caused by a cutting part of a mine machine.

5. A mine roof support as claimed in claim 1, in which rear edges of said parallel floor engaging members and rear edges of said canopy are alignable such that in use they will be substantially the same distance from a mine face.

6. A mine roof support as claimed in claim 1, in which said linkage means comprises an upper shield member pivotally connected at pivot points to said mine roof engaging canopy and at least one pair of links each pivotally connected at pivot points to said base and to said upper shield member.

7. A mine roof support as claimed in claim 6, in which a longitudinal axis of said second hydraulic jack means is not parallel to a line joining said pivot points of said upper shield member, there being a first acute angle between said longitudinal axis of said second hydraulic jack means and a line joining said pivot points of said upper shield member.

8. A mine roof support as claimed in claim 7, in which a line joining said pivot points of one link of said pair of links forms a second acute angle with a line joining said pivot points of the other link of said pair.

9. A mine roof support as claimed in claim 8, in which said first acute angle is substantially equal to said second acute angle.

10. A mine roof support as claimed in claim 7, in which said acute angle increases as said mine roof engaging canopy is raised by said first hydraulic jack means.

11. A mine roof support as claimed in claim 10, in which, as said mine roof engaging canopy is raised, said acute angle opens in the manner of a fan about a horizontal plane extending between said roof engaging canopy and said base.

12. A mine roof support as claimed in claim 1, in which said second hydraulic jack means lies between said spacedapart floor engaging members and above an advancing hydraulic ram located between said spaced-apart floor engaging members when said mine roof support is fully lowered.

* * * * *